United States Patent [19]

Yuge et al.

[11] 4,373,802

[45] Feb. 15, 1983

[54] PRE-OPERATIVE TIME DISPLAY SYSTEM FOR COPYING MACHINES

[75] Inventors: Shizuo Yuge, Toyokawa; Nobuo Kitou, Aichi; Toshio Yamamoto, Toyokawa; Michiru Kanesaka, Sakai, all of Japan

[73] Assignee: Minolta Camera Co., Ltd., Osaka, Japan

[21] Appl. No.: 213,588

[22] Filed: Dec. 5, 1980

[30] Foreign Application Priority Data

Dec. 12, 1979 [JP] Japan ..... 54-161920

[51] Int. Cl.[3] ..... G03G 15/20

[52] U.S. Cl. ..... 355/14 FU; 219/216; 355/14 C

[58] Field of Search ..... 355/3 FU, 14 C, 14 FU, 355/30; 219/216

[56] References Cited

U.S. PATENT DOCUMENTS

| | | | |
|---|---|---|---|
| 3,878,358 | 4/1975 | Barton et al. | 219/216 |
| 4,145,599 | 3/1979 | Sakurai et al. | 219/216 |
| 4,324,486 | 4/1982 | Nishikawa | 219/216 X |

FOREIGN PATENT DOCUMENTS 2011660 7/1979 United Kingdom .

OTHER PUBLICATIONS

W. E. White, "Temperature Sensing and Control of a Fusing Roll", *Research Disclosure*, No. 135, pp. 73–74, Jul. 1975.

*TMX 1117IL 4-Bit Microcomputer Preprogrammed Microwave Oven Controller Manual*, by Texas Instruments, 1976.

*Primary Examiner*—G. Z. Rubinson
*Assistant Examiner*—Keith E. George
*Attorney, Agent, or Firm*—Jackson, Jones & Price

[57] ABSTRACT

A waiting time display system specifically for use in a copying machine includes a temperature sensor for monitoring the specific temperature of heat fixing rollers. Electronic processing is responsive to the varying signal outputs of the sensor and correspond to the rise of the temperature detected. A display panel is driven so that a plurality of lights are sequentially activated and deactivated to indicate time and temperature. An audio signal can also be provided to indicate the machine can be activated for copying. An operator can now gauge the amount of time until the copy machine is capable of being operative.

11 Claims, 6 Drawing Figures

PRE-OPERATIVE TIME DISPLAY SYSTEM FOR COPYING MACHINES

BACKGROUND OF THE INVENTION

1. Field of the Invention

The present invention relates to a display system for determining the preliminary waiting time period before a copying machine can be operated, and more particularly, to a visual and audio display system for use on an electronic copying machine having a heat fixing unit for fusing the toner which requires a preliminary heating time period prior to operation of the copying apparatus.

2. Description of the Prior Art

Electronic copying machines frequently incorporate a heat fixing unit to fuse the toner image onto the copy paper. Before the machine can be operated, a preliminary time period is necessary to permit the heat fixing unit to reach a predetermined temperature. This time period frequently takes one to several minutes to provide ample time for the temperature to rise in the heat fixing unit to the predetermined level after the power is turned on. During this time period, the copying machine is disabled from operation and a simple visual display, such as the word "WAIT" is lit on the control console.

As can be readily appreciated, the waiting time will vary depending upon the ambient condition in which the copying machine is used. The simple display of the visual indication "WAIT" is insufficient in telling the operator how long it must take to bring the machine into condition for use. Frequently, the operator's efforts to wait to check up on the status of the copy machine produces frustration, even if the waiting period is as short as several minutes.

An example of a copying machine of this general type is disclosed in U.S. Pat. No. 4,158,886.

SUMMARY OF THE INVENTION

An object of the present invention is to provide a control console display system which is particularly useful in copying machines having a heat fixing unit wherein a visual display indicates the particular status of the temperature of the fixing unit.

Another object of the present invention is to provide a display system that is capable of notifying the user of the waiting time by sequentially activating a plurality of lamps, one after another, that correspond with the particular rise in temperature of the heat fixing unit until the temperature reaches the predetermined specified level.

Another object of the present invention is to provide a display system that incorporates an audio unit for indicating the operative status of the copying machine.

The present invention is incorporated into an electronic copying machine that is capable of reproducing copies of original documents with the assistance of a heat fixing unit for fusing the toner image onto the copy. The heat fixing unit is of the type that must be preheated to a predetermined temperature prior to the initiation of a copying procedure to ensure the proper application of heat to the toner image. A control console is provided with subjective operator controls to permit an operator to instruct the copying machine into a desired operational mode. A temperature sensing monitor is located adjacent the heat fixing roller unit for actually measuring the surface temperature at any point in time. The heat monitor, with accompanying electric circuitry, is capable of converting the level of heat into an appropriate electrical signal which corresponds to each discrete level of temperature that is desired to be monitored. Finally, display means are operatively positioned relative to the control console and are responsive to the output signals from the control means to provide an indication to the operator of the status of the temperature of the heat fixing unit and its relative time relationship to the final operative predetermined temperature to initiate a copying operation. The present invention is further capable of incorporating a microprocessor with appropriate software programming as an alternative means of achieving some of the functions of the present invention.

The object and features of the present invention are set forth in the appended claims. The present invention may be best understood by reference to the following description, taken in conjunction with the accompanying drawings in which like numerals indicate like parts.

DESCRIPTION OF THE PREFERRED EMBODIMENT

The following specification, taken in conjunction with the drawings, sets forth the preferred embodiments of the present invention in such a manner that any person skilled in the electrophotographic copying machine field can practice the invention. The embodiments of the invention disclosed herein are the best modes contemplated by the inventors for carrying out their invention in a commercial environment, although it should be understood that various modifications can be accomplished within the parameters of the present invention.

Figure 1:
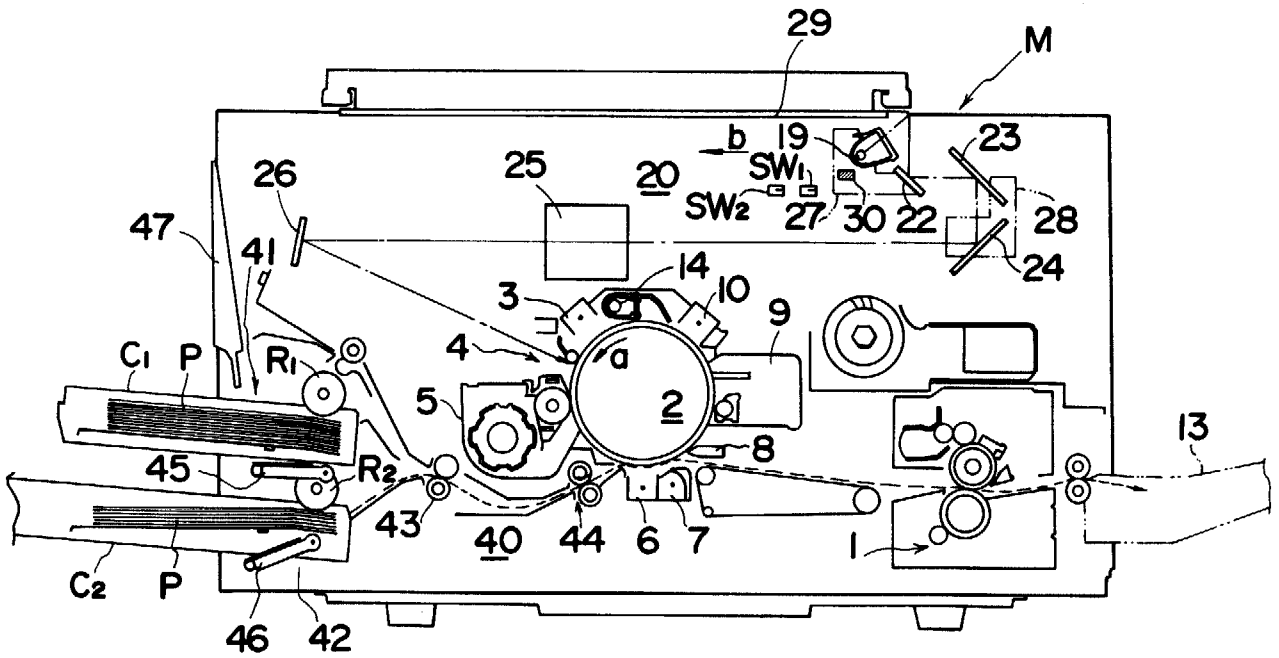
FIG. 1 is a cross sectional schematic view showing an electrophotographic copying machine including a heat fixing unit.

Referring now to the drawings, and more particularly to the schematic cross sectional view of FIG. 1, an embodiment of an electrophotographic copying machine, M, equipped with a display system in accordance with the present invention is shown. The construction and operation of the copying machine, M, will be subsequently described with reference to this figure.

A photoconductive drum 2, rotatable in the direction of an arrow a, is positioned approximately in the center of the main body of the copying machine, M. Arranged sequentially around the drum 2 are a sensitizing charger unit 3, an exposure slit member 4, a developing unit 5, a transfer charger unit 6, an erasing a-c charger 7, a separating paper pawl 8, a cleaning unit 9, a precharger 10, and an eraser lamp 14. When the photoconductive drum 2 rotates, these components act on the photoconductive surface of the drum in succession to transfer a toner image from an original document onto copy paper, P, that has been fed to the drum 2 in time relationship to the rotation of the drum.

More specifically, the photoconductive surface of the drum 2 is precharged by the charger 10 after a cleaning step, then the drum is illuminated with the eraser lamp 14 for the removal of any latent charges. The drum is thereafter charged again by the sensitizing charger 3 with the desired image. An original document (not shown) is scanned by an optical scanning system, to be described later, to continuously project the image of the original document onto the charged surface of the drum through an exposure slit member 4 to form the latent electrostatic image. This electrostatic image is subsequently developed by the developing unit 5 with a toner. The toner image on the drum is subsequently transferred onto the copy paper, P, which has been delivered to the drum in a timed relationship to the image forming operation. The copy paper, now bearing the toner image, is separated from the drum surface by the erasing a-c charger and the separating paper pawl 8. The separated copy paper is then fed to a heat fixing unit 1 wherein the toner image is thermally fixed, e.g., between pressure rollers, to the paper, P. The printed copy is then discharged from the main body onto a receptacle tray 13. Any toner that remains on the surface of the drum 2 after the image transfer is scraped off the surface by the cleaning unit 9. The precharging step, previously mentioned, thereafter follows preparatory to a subsequent copying process.

The optical scanning system 20 comprises an exposure lamp 19, a first reflector 22, a second reflector 23, a third reflector 24, a lens unit 25, and a fourth reflector 26. The exposure lamp 19 and the first reflector 22 are mounted for movement together on a scanning unit 27. The specifics of the scanning unit are not disclosed since they are of a conventional form. The second and third reflectors 23 and 24 are movable together as held by a support unit 28. The fourth reflector 26 is fixed in a predetermined position. The scanning unit 27 and the reflector support unit 28 are associated with drive means and guide means (not shown) so that when an original document on the glass plate 29 is scanned, the units 27 and 28 are movable in the direction of an arrow b that is parallel with the glass plate 29 at speeds of V/M and V/2M, respectively, wherein V is the speed of rotation of the drum 2 (i.e., the speed of transport of the copy paper P) and M is the magnification of the copy.

The scanning unit 27 is provided with a switch actuator 30, which, in conjunction with the travel of the unit 27, successively operates control switches SW1, SW2, etc., that can be arranged along the path of travel of the unit 27 to emit signals for controlling the operation of the copying machine M.

A system 40 for feeding and transporting the copy paper P comprises cassette loading portions 41 and 42 formed in the main body in two superposed stages, feed rollers $R_1$, $R_2$ disposed in fixed positions above the loading portions 41 and 42, respectively, intermediate rollers 43, and timing rollers 44. The upper and lower loading portions 41, 42 are loaded with cassettes $C_1$, $C_2$ containing piles of copy paper P, which are pressed against the feed rollers $R_1$, $R_2$ by pushing members 45, 46. One of the feed rollers $R_1$, $R_2$, is selectively rotated to feed the copy paper P into the main body.

The copy paper P sent out from the cassette $C_1$ or $C_2$ is temporarily impeded by coming into contact with the intermediate rollers 43, which then rotate with suitable timing to bring the paper to the timing rollers 44, by which the paper is impeded again. In response to a signal given in timed relation to the travel of the toner image formed on the drum 2, the timing rollers are driven to feed the paper to the transfer station.

Figure 2:
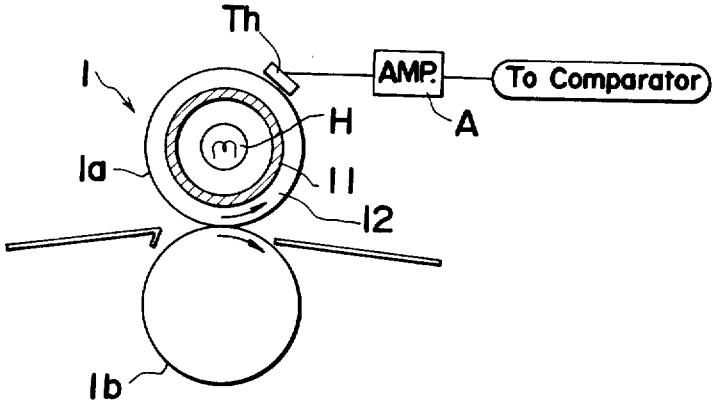
FIG. 2 is an enlarged schematic elevational view showing the heat fixing unit.

FIG. 2 is an enlarged view showing, for illustrative purposes, the fixing unit 1 which is of heat roller type. The unit 1 comprises rollers 1*a* and 1*b* which, when driven, fix the toner image to the copy paper P with heat and pressure while conveying the paper. The construction of the unit 1, which is already known to the art, will not be described in detail.

When the heat roller type fixing unit 1 has a heater H especially as housed in an aluminum or the like metal cylinder 11 which is covered with a silicone rubber layer 12, the layer 12 requires a longer time to reach the fixing temperature than in fixing units of other types, resulting in a waste of a longer waiting time for the operator. The present invention utilizes the output of a temperature detecting circuit including a temperature monitor or sensor (such as thermister or thermocouple) Th,heretofore used for monitoring and controlling the operative temperature of fixing units, for further providing indications of the surface temperature of the heat roller during the initial rise of the surface temperature so as to enable the user to utilize the waiting time effectively to the greatest possible extent.

Figure 3:
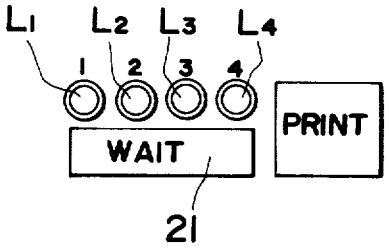
FIG. 3 is a schematic view showing an arrangement of display lights of the display system.

As shown in FIG. 3, for example, a "WAIT" display portion 21 is adapted to stay on while the machine M is held out of mechanical operation until the heat roller 1*a* is heated to a specified operative surface temperature. Temperature indicating lamps L1 to L4 are turned on one after another corresponding to the rise of the temperature, to notify the user of the temperature of the heat roller relative to the proper operating temperature. The user will then have a greater feeling of control than when the display "WAIT" alone is given and will be able to use the waiting time for other purposes.

Figure 4:
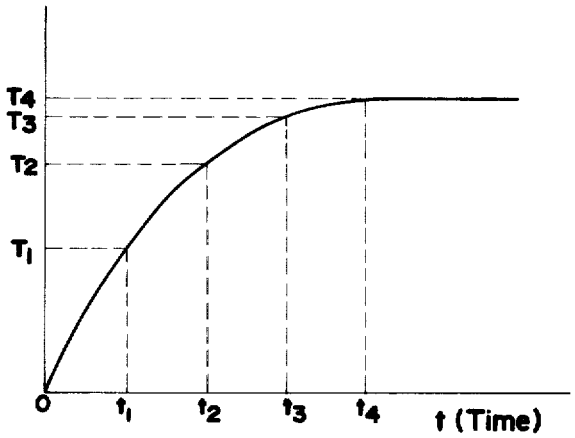
FIG. 4 is a graph disclosing the rise in surface temperature versus time for a conventional heat fixing unit roller.
Figure 5:
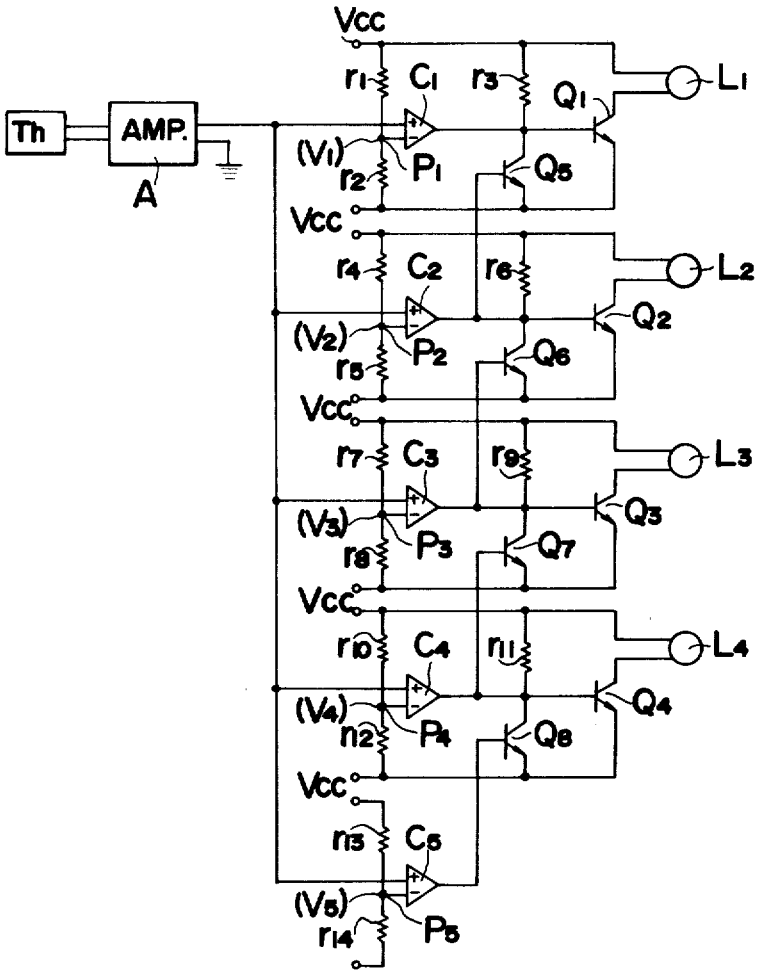
FIG. 5 is a schematic electrical circuit showing one form of control circuit with the display system.

FIG. 4 is a graph showing the relationship between absolute time t and the surface temperature T of a usual heat roller. FIG. 5 shows an exemplary electrical circuit for successively turning on the lamps L1 to L4 in accordance with the surface temperature actually detected by the temperature sensor Th.

With reference to FIG. 4, when the heater H is heated to a preset temperature T4 after the application of power, the display "WAIT" goes off, and the machine M is in condition to commence a copying operation. The heater H is thereafter maintained at an approximately constant level, i.e., at T4, with its power supply suitably controlled by an unillustrated circuit through the monitoring of heat sensor Th. Assuming that the period of time taken for the roller surface temperature to reach the level T4 is t4, the period of time t4 is divided arbitrarily into four approximately equal portions as at t1, t2 and t3 to determine on the graph the temperatures T1, T2 and T3 corresponding to those points on the time scale. The lamps L1 to L4 are adapted to go on one after another every time the temperature detected by the sensor Th reaches the levels T1 to T3 successively. Under any ambient condition, the time taken for the roller to reach T1 is therefore approximately ¼ the time needed for the rise to T4. Thus, the user can make a proximate estimate of the waiting time.

The lamps are controllable, for example, by the circuit of FIG. 5 in the following manner. The output from the temperature sensor Th shown in FIG. 2 is amplified by an amplifier A and then fed to the (+) input terminals of comparators C1 to C5. Voltages V1 to V5 obtained by dividing a constant voltage Vcc are applied to the (−) input terminals of the comparators C1 to C5, respectively. Each of the comparators C1 to C5 is set to give "H" output when the output voltage of the amplifier A exceeds the corresponding one of the reference voltages V1 to V5.

The outputs of the comparators C1 to C4 are connected to the bases of transistors Q1 to Q4, the collectors of which are connected to the lamps L1 to L4, respectively. When the base voltage reaches an "H" level, the corresponding transistor conducts to turn on the lamp concerned. On the other hand, the outputs of the comparators C2 to C5 are connected to the bases of the transistors Q5 to Q8, with their collectors connected to the bases of the transistors Q1 to Q4, respectively. Consequently, when the output of one of the comparators C2 to C5 reaches an "H" level, the base voltage of the corresponding one of the transistors Q1 t1 Q4 drops to turn off the lamp connected to that transistor. Thus, the lamps L1 to L4 go off one after another.

The reference voltage V1 is the voltage determined by resistors r1 and r2 and available at a dividing point P1, such that when the temperature detected by the sensor Th is approximately at the usual room temperature level (15° C. to 20° C.), the comparator C1 gives "H" output. Accordingly, the transistor Q1 conducts to turn on the lamp L1 usually upon energization of the heater H.

The voltage V2 corresponds to the output of the amplifier A when the above-mentioned temperature T1 is detected, and is given by resistors r4 and r5 at a voltage dividing point P2. When the detected temperature exceeds the temperature T1, the comparator C2 produces "H" output, bringing the transistors Q2 and Q5 into conduction and the transistor Q1 out of conduction. This turns on the lamp L2 and, at the same time, turns off the lamp L1. The voltages V3 to V5 correspond to the detected temperatures T2 to T4. In the same manner as above, the lamps L2 to L4 are turned on and off in succession. On reaching the temperature setting T4, the detected temperature turns off the lamp L4 and the display "WAIT", bringing the machine M into condition for a copying operation. The circuit for turning on and off the display "WAIT" and for preventing the copying operation during the waiting time is known and, therefore, is not shown in FIG. 5 and will not be described. The output of the final comparator C5, for example, is advantageously usable for such a circuit.

Figure 6:
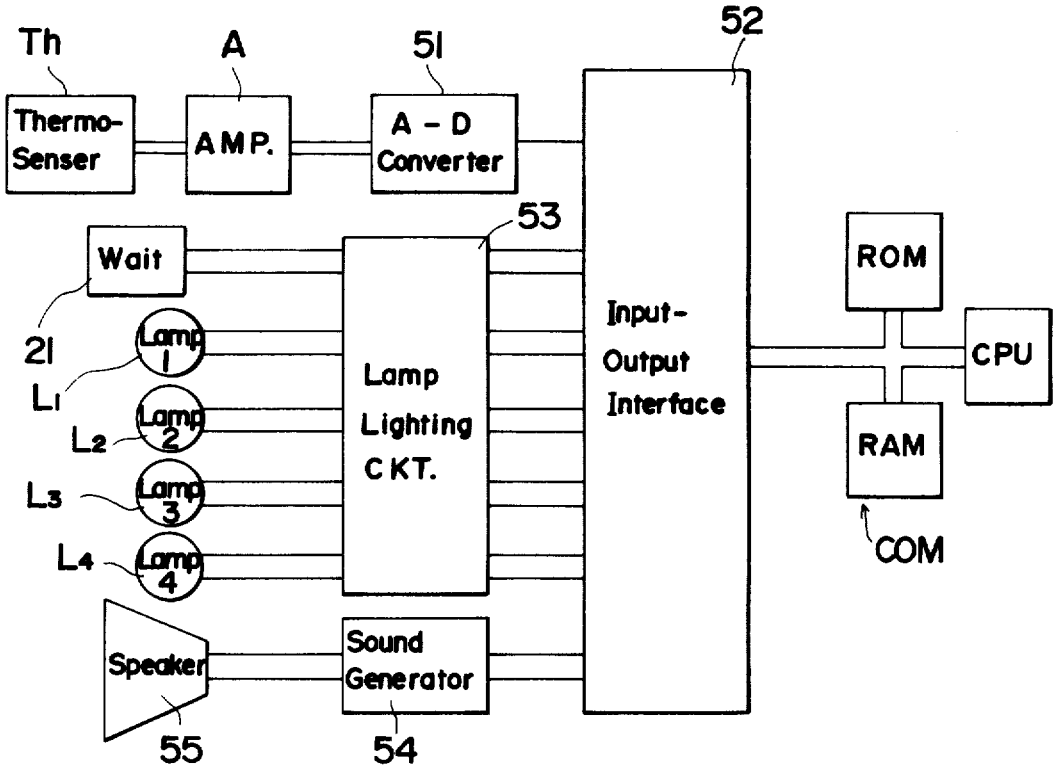
FIG. 6 is a block diagram showing another embodiment of the display system when a microcomputer is used for controlling the display system.

When the copying machine includes a microprocessor or microcomputer COM for controlling its operation, the microcomputer COM can be used also for indicating the rise of the temperature of the heat roller 1. FIG. 6 shows such an arrangement. Thoughout the drawings, like parts are referred to by like reference numerals or characters.

The output of the amplifier A described above is converted by an A-D converter 51 to digital signals, which are fed to the microcomputer COM through an input-output interface 52. The microcomputer COM includes a central processing unit CPU, a random access memory RAM, and a read-only memory ROM. The temperature signals are temporarily stored in the random access memory RAM with suitable timing and compared with the temperature data T1 to T4 numerically stored in the read-only memory ROM. In accordance with the temperature detected and based on the comparison, the input-output interface 52 feeds control signals to a lamp lighting circuit 53 to turn the lamps L to L4 on and off successively as is the case with the circuit of FIG. 5.

FIG. 6 further shows a sound generator 54 and a speaker 55 which are activated upon the lapse of the waiting time in response to a control signal from the microcomputer COM to give the user an audible indication that the copying machine is ready for use.

Copying machines are usually adapted to become usable at a temperature slightly lower than the temperature setting for the heat fixing unit, i.e., the temperature T4 in FIG. 4, so that the control circuit of FIG. 5 may also be so designed that the "WAIT" lamp 21 goes off before the temperature T4 is reached, using another comparator.

The audible indicator comprising the sound generator 54 and speaker 55, if provided, enables the user to utilize the waiting time more efficiently. The sound generator 54 may be adapted to be turned off with the start of the copying machine by the user, or may be adapted to go off by a timing stop switch circuit.

The lamps L1 to L4 included in the foregoing embodiments for indicating the rise of the temperature are in no way limitative, and a suitable number of lamps in any desired shape are usable. The display lamp "WAIT", although shown as separately disposed on a control console, need not always be provided since the temperature indicating lamps are also serviceable as such. Instead of the successive on-off control of the lamps L1 to L4 described above, the lamps may stay on in a successively increasing number. Alternatively, some other means such as light emitting diodes may be usable for continuously indicating the rise of the temperature.

In summary, the waiting time display system of this invention comprises means for detecting the temperature of the surface of a heat fixing unit, and means for providing changing indications in accordance with the temperature detected. During the rise of the temperature, therefore, the system tells the user how long he should wait, rather than depend solely on the display of "WAIT" only, consequently enabling the user to utilize this time effectively.

The present system, when adapted to notify the user of the lapse of the waiting time with a sound, has another advantage in that the waiting time can be utilized more effectively at a distance from the copy machine.

Modifications to the above-described embodiments of the present invention may become readily apparent to those skilled in the art in light of the above-disclosed generic concepts. Therefore, the scope of the present invention should be interpreted solely from the following claims.

We claim:

1. In an electronic copying machine for reproducing copies of original documents having a heat fixing unit, for fixing toner images formed on the copies, that must be preheated to a predetermined temperature prior to initiation of a copying procedure and having a control console with subjective operator controls to provide a desired operational mode of the copying machine, the improvement comprising:

means for detecting discrete levels of temperature of the heat fixing unit;

control means for providing output signals corresponding to each discrete level of temperature of the heat fixing unit, and display means operatively positioned relative to the control console and responsive to the output signals to provide an indication to the operator of the status of temperature of the heat fixing unit and its relative timed relationship to the final operative predetermined temperature before initiating a copying operation.

2. The invention of claim 1 wherein the copy machine heat fixing unit further includes a pair of pressure rollers at least one of which is heated and a temperature sensor for measuring the surface temperature of the heated roller and generating an electrical voltage signal, the means for detecting discrete levels of temperature includes a plurality of comparator members biased to provide individual outputs at discrete levels of voltage to activate sequentially the display means.

3. The invention of claim 2 further including an audio generator means for responding to a final comparator output with an audio signal indicating the copy machine is operable.

4. The invention of claim 2 wherein the display means further includes an illuminated visual panel member on the control console with indicia indicative of a preliminary pre-operational mode of the copy machine, the visual panel member being deactivated by the comparator member associated with the final discrete level of voltage generated by the temperature sensor.

5. The invention of claim 2 wherein the display means further comprises a plurality of lamps turned on one after another in response to the varying signal outputs of the control means.

6. The invention of claim 1 wherein the display means further comprises a plurality of lamps turned on one after another in response to the varying signal outputs of the control means.

7. The invention of claim 1 wherein the control means further comprises a comparing means for comparing a signal of the detected temperature of the heat fixing unit to be heated with predetermined reference levels and for generating outputs when a level of the signal of the detected temperature exceeds the reference levels.

8. The invention of claim 7 wherein the comparing means comprises a microcomputer apparatus having a plurality of stored data of the reference levels and the control means further includes an analog-digital converter for outputting a digital signal proportional to the signal of the detected temperature to address the stored data of the microcomputer for subsequent driving of the display means.

9. In an electronic copying machine for reproducing copies of original documents having a heat fixing unit, for fixing toner images formed on the copies, that must be preheated to a predetermined temperature prior to initiation of a copying procedure and having a control console with subjective operator controls to provide a desired operational mode of the copying machine, the improvement comprising:

means for detecting discrete levels of temperature of the heat fixing unit at progressively smaller increments of temperature levels;

control means for providing output signals at equally incremented discrete time periods corresponding to each discrete level of temperature of the heat fixing unit, and display means operatively positioned relative to the control console and responsive to the output signals to provide an indication to the operator of the status of the temperature of the heat fixing unit and its relative timed relationship to the final operative predetermined temperature required for initiating a copying operation, the display means further including an illuminated visual panel member on the control console with progressive indications of the discrete time periods preceding the final operative predetermined temperature.

10. The invention of claim 9 wherein the copy machine heat fixing unit further includes a pair of pressure rollers at least one of which is heated and a temperature sensor for measuring the surface temperature of the heated roller and generating an electrical voltage signal, the means for detecting discrete levels of temperature includes a plurality of comparator members biased to provide individual outputs at discrete levels of voltage to activate sequentially the display means, the visual panel member being deactivated by the comparator member associated with the final discrete level of voltage generated by the temperature sensor.

11. The invention of claim 9, further including an audio generator means for responding to a final comparator output with an audio signal indicating the copy machine is operable.

* * * * *